United States Patent [19]

Shimizu

[11] 4,058,704

[45] Nov. 15, 1977

[54] COILABLE AND SEVERABLE HEATING ELEMENT

[75] Inventor: Masao Shimizu, Tokyo, Japan

[73] Assignee: Taeo Kim, Fuchu, Japan

[21] Appl. No.: 638,910

[22] Filed: Dec. 8, 1975

[30] Foreign Application Priority Data

Dec. 27, 1974 Japan ..... 49-3820
Dec. 27, 1974 Japan ..... 49-3819

[51] Int. Cl.[2] ..... H05B 3/34

[52] U.S. Cl. ..... 219/528; 174/117 F; 219/542; 219/543; 219/549; 338/211

[58] Field of Search ..... 219/211, 212, 528, 535, 219/542, 543, 549; 338/211, 212, 214; 174/175 R, 117 F, 117 M; 252/511; 428/232

[56] References Cited

U.S. PATENT DOCUMENTS

| | | | |
|---|---|---|---|
| 2,473,183 | 6/1949 | Watson | 219/543 |
| 2,669,646 | 2/1954 | Ford | 338/211 X |
| 3,257,498 | 6/1966 | Kahn | 174/75 R |
| 3,281,579 | 10/1966 | Glicksman | 219/535 |
| 3,344,385 | 9/1967 | Bartos et al. | 338/212 |
| 3,359,524 | 12/1967 | Gallacher et al. | 219/549 X |
| 3,385,959 | 5/1968 | Ames et al. | 219/549 |
| 3,387,248 | 6/1968 | Ries | 338/211 |
| 3,757,087 | 9/1973 | Bernard | 219/549 |
| 3,793,716 | 2/1974 | Smith-Johannsen | 29/611 |
| 3,858,144 | 12/1974 | Bedard et al. | 338/22 R |

*Primary Examiner*—Volodymyr Y. Mayewsky
*Attorney, Agent, or Firm*—Karl F. Ross

[57] ABSTRACT

A flexible tape, adapted to be rolled into a coil and to be cut into sections of any desired length, includes an elongate carrier of woven cloth impregnated with a flexible, carbon-containing resistance layer and a flexible heat shield, coextensive with the carrier, on one side of that layer, this assembly being enveloped in a flat sheath of synthetic resin. A surface of the sheath on the side of the heat shield may be coated with adhesive for detachably securing a backing strip of paper thereto. Two transversely spaced conductors, extending adjacent the longitudinal edges of the tape over the entire length thereof, are in conductive contact with the resistance layer for facilitating the passage of a heating current therethrough. The ends of the conductors in a section cut from the tape can be bared by removing parts of the sheath, the carrier and the heat shield. Several such sections can be laterally juxtaposed for the heating of a larger area.

4 Claims, 8 Drawing Figures

Fig. 4
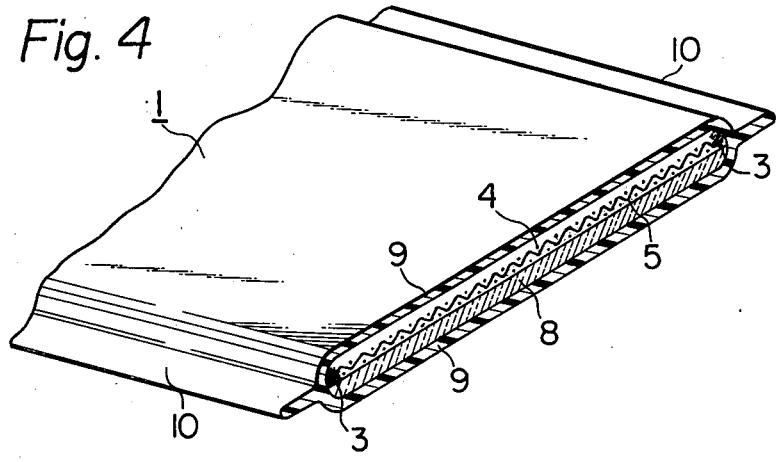
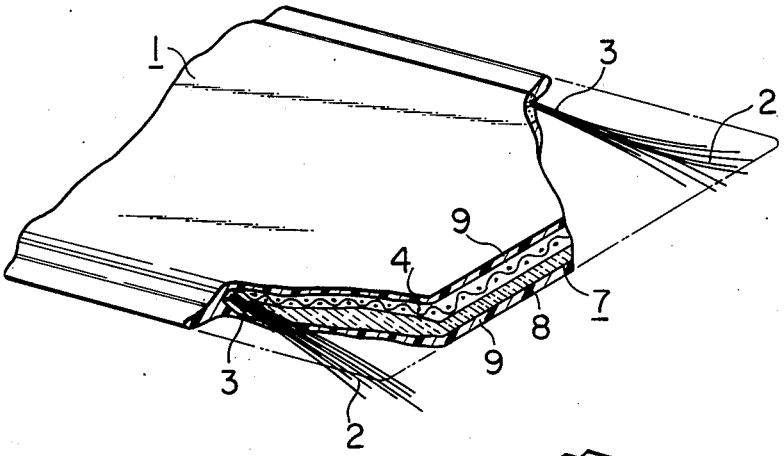
Fig. 5
Fig. 6
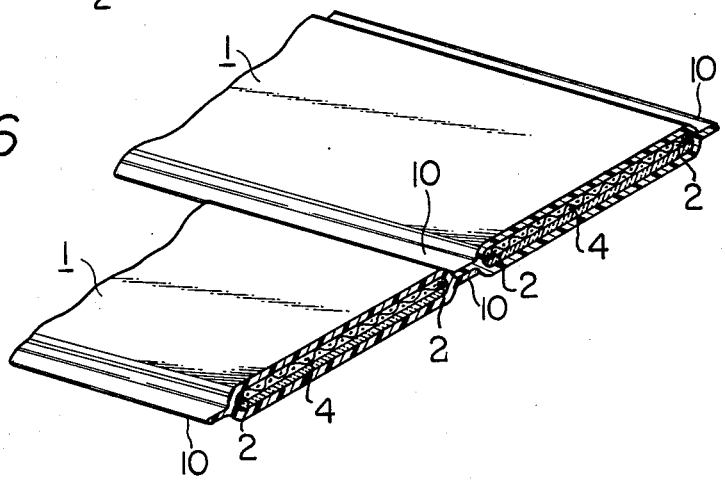

COILABLE AND SEVERABLE HEATING ELEMENT

FIELD OF THE INVENTION

My present invention relates to a heating element wherein a resistance layer enveloped in an insulating sheath is energizable with a heating current passing through a pair of transversely spaced conductors in contact with that layer.

BACKGROUND OF THE INVENTION

Resistance layers to be used in such heating elements are conventionally formed from a nonconductive matrix, e.g. of polymeric material, with carbon particles imbedded therein. Such layers may have a certain flexibility permitting bending of the heating elements incorporating them.

OBJECT OF THE INVENTION

The object of my invention is to provide an improved heating element of this general type, which can be rolled into a coil for storage purposes and from which sections of any desired length can be cut, radiating heat in one direction only.

SUMMARY OF THE INVENTION

In accordance with my present invention, a flexible tape designed to be used as a heating element includes an elongate carrier of woven cloth impregnated with a flexible, carbon-containing resistance layer in contact with two transversely spaced conductors extending adjacent the longitudinal edges of the carrier over its entire length, this assembly being enveloped in a flat resinous sheath. The tape can be coiled and can also be transversely severed; upon such severance, cutting away parts of the sheath and the carrier exposes terminal portions of the conductors to facilitate their connection to a source of heating current. A flexible heat shield is inserted into the sheath on one side of the carrier and a sheath surface on the same side may be adhesively coated whereby a backing strip of paper can be detachably secured to the tape.

BRIEF DESCRIPTION OF THE DRAWING

The above and other features of my invention will now be described in detail with reference to the accompanying drawing in which:

FIG. 4 is a perspective view showing a section of the tape of FIG. 1;

FIG. 5 is a perspective view of a terminal tape portion partly cut away to expose its electric conductors;

FIG. 6 is an enlarged partial perspective view of two juxtaposed heat-generating tapes according to my invention;

SPECIFIC DESCRIPTION

Figure 1:
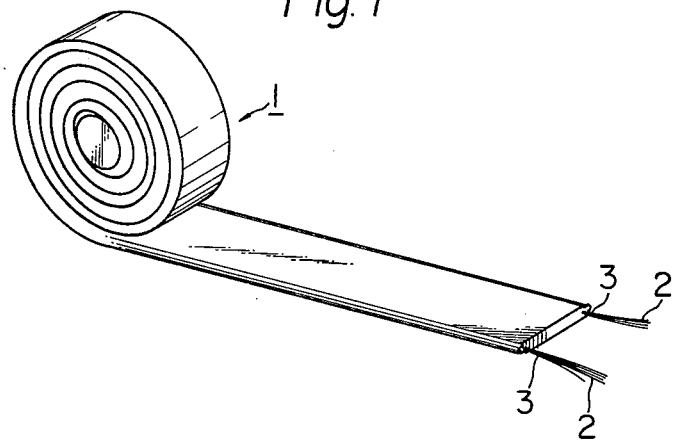
FIG. 1 is a perspective view of a heat-generating tape according to the present invention.

FIG. 1 illustrates a heat-generating tape 1 according to the present invention, shown rolled into a coil. Terminal portions 2 of a pair of electric conductors 3, each consisting of a bundle of thin wires, project endwise from the tape.

Figure 2:
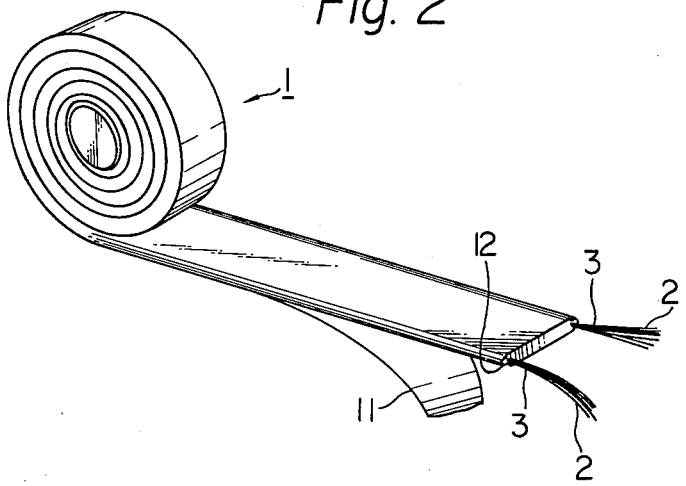
FIG. 2 is a perspective view similar to FIG. 1, showing the tape provided with an adhering paper strip.

FIG. 2 shows the tape 1 provided with a separable paper strip 11 partially peeled from an adhesive layer 12 on one of its surfaces.

Figure 3:
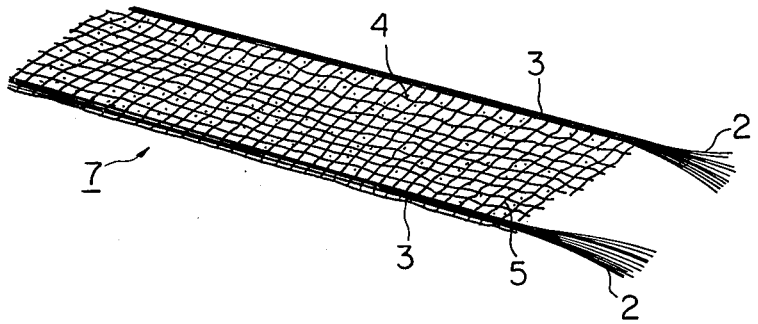
FIG. 3 is a perspective view of a carbon layer formed on a woven cloth, constituting the core of the tape.

The body of the heating element 1 shown in FIGS. 1 and 2 includes an elongate core member 7 which consists of soft tapelike woven cloth 4, e.g. of cotton, impregnated with a carbon-containing flexible resistance layer 5 of conventional composition as shown in FIG. 3. The electric conductors 3 are disposed on the woven cloth 4 in electric contact with the resistance layer 5 and extend along the longitudinal edges of the tape with transverse separation. A thermally insulating member 8, e.g. a glass-fiber layer, is disposed on the lower surface of the woven cloth 4, as seen in FIG. 4, for letting heat radiate only in one direction. Two electrically insulating flexible synthetic-resin layers or foils 9 enclose the core member 7, lead wires 3 and insulating member 8 therebetween, so as to complete the heat-generating tape 1.

As seen in FIG. 4, the upper and lower layers 9 of synthetic resin have longitudinal marginal zones merged into edge portions 10 so as to form a flat sheath enclosing the core member 7, the insulating layer 8 and the lead wires 3 therebetween.

Figure 7:
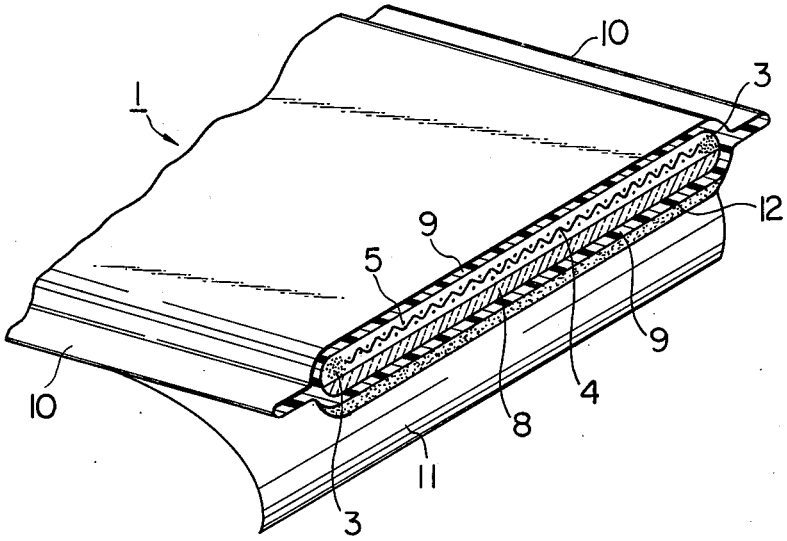
FIG. 7 is a perspective view similar to FIG. 4 but showing the tape with the paper strip of FIG. 2.

FIG. 7 shows the adhesive layer 12 of FIG. 2 formed on the outer surface of that synthetic-resin layer 9 which is in contact with the heat-insulating member 8, i.e. on the lower surface of tape 1 as seen in the Figure. The adhesive layer 12 is covered by the separable paper strip 11. This layer advantageously consists of a thermosetting adhesive.

Figure 8:
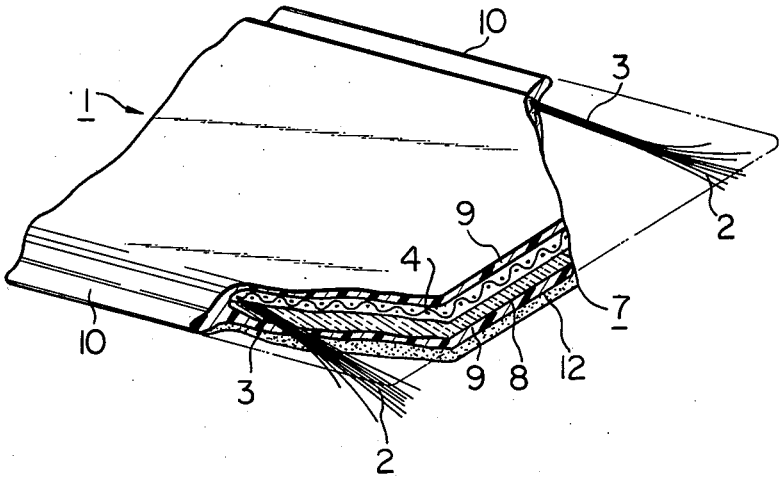
FIG. 8 is a perspective view similar to FIG. 4 but relating to the tape of FIGS. 2 and 7.

Since the coilable heating element 1 according to my invention is made mainly of woven cloth and synthetic-resin layers, the tape 1 can be transversely cut at a selected location with exposure of a terminal portion 2 of each conductor 3 by partially removing the layers 9, the heat shield 8 and the core 7 from the cut edge, as shown in FIGS. 5 and 8. These terminals 2 can be joined to an electric plug (not shown) for connection to a power source (likewise not shown); they could also be used for connection to another heat-generating tape 1.

In operation, as an electric current is supplied to the conductive parts 3, 5 of tape 1 through the terminals 2, the resistance layer 5 generates heat. It is possible to use a thermostat (not shown) to hold the tape temperature at a selected level of, for instance, about 70° C.

The heat generated by the resistance layer 5 emanates only in the direction opposite the heat-insulating member 8. If the covering synthetic-resin layers 9 are made of a material having a high thermal conductivity, the heat from the resistance layer 5 is transmitted with little heat loss to an object to be heated. Since the synthetic resin forming the layers 9 is electrically insulating, the risk of electric shock is completely eliminated even when the heat-generating tape 1 is energized.

In order to heat larger surfaces, e.g. floors and sidewalls of a house (not shown), the heat-generating tape 1 is cut into sections of suitable length which can be juxtaposed side-by-side and electrically interconnected, with the edge portions 10 of the adjacent tape sections overlapping, as shown in FIG. 6. Tapes of the type shown in FIGS. 2, 7 and 8 can be easily secured to a wall or some other object simply by peeling off the separable paper strip 11 and pressing the tape against the object with the adhesive layer 12 facing it. The overlapping of the edge portions 10 of adjacent tape sections, lying substantially on the level of core members 7, avoids any superposition of the woven carriers 4 and their resistance layers 5 while ensuring coverage of the desired area without any gaps. Accordingly, uneven temperature distribution and abnormal temperature rise or excessive heat generation can be prevented.

Since the components of my improved heat-generating tape 1 are all flexible, it is possible to wind the tape 1 on a cylindrical conduit such as a water-supply pipe. Thus, the tape 1 can be used for preventing the water in such pipes from freezing and protecting such pipes from resulting rupture.

As will be apparent from the foregoing disclosure, the flexible heat-generating tape according to the present invention is readily severable and reconnectible. There are no limitations on the shape and the size of the tape which can be used for heating any residential houses, greenhouses and the like.

I claim:

1. A heating element comprising a flexible tape rolled into a coil, said tape including an elongate carrier of woven cloth impregnated with a flexible carbon-containing resistance layer enveloped in a flat resinous sheath, a layer of inorganic fibers forming a flexible heat shield on one side of said carrier within said sheath, and two transversely spaced conductors extending adjacent the longitudinal edges of said carrier over the entire length thereof in conductive contact with said resistance layer, said tape being transversely severable into sections with exposure of terminal portions of said conductors by removal of parts of said sheath and said carrier, said sheath having an adhesive-coated surface on the side of said heat shield and a backing strip detachably bonded to said surface.

2. A heating element as defined in claim 1 wherein said inorganic fibers are of glass.

3. A heating element comprising a plurality of sections of flexible tape positioned side-by-side, said tape including an elongate carrier of woven cloth impregnated with a flexible carbon-containing resistance layer enveloped in a flat resinous sheath, a layer of inorganic fibers forming a flexible heat shield on one side of said carrier within said sheath, and two transversely spaced conductors extending adjacent the longitudinal edges of said carrier over the entire length thereof in conductive contact with said resistance layer, said sheath having longitudinal edge portions substantially on the level of said carrier, said sections being juxtaposed with adjoining edge portions thereof overlapping each other, the sheath of each of said sections having an adhesive-coated surface on the side of said heat shield and a backing strip detachably bonded to said surface.

4. A heating element as defined in claim 3 wherein said inorganic fibers are of glass.

* * * * *